United States Patent [19]

Denmark

[11] 3,945,640

[45] Mar. 23, 1976

[54] MOUNTING FOR FIGURES

[75] Inventor: James Denmark, Ilkley, England

[73] Assignee: Subbuteo Sports Games Limited, England

[22] Filed: Dec. 4, 1974

[21] Appl. No.: 529,285

[30] Foreign Application Priority Data

Aug. 27, 1974 United Kingdom ..... 37358/74

[52] U.S. Cl. ..... 273/85 R; 46/155; 273/137 W

[51] Int. Cl.[2] ..... A63F 7/08

[58] Field of Search.. 273/85, 127 R, 127 B, 127 D, 273/129, 137 R, 137 AE, 137 AB, 137 AC, 137 W, 87.4, 94, 131 C, 134 AG, 134 CB, 134 DB, 134 ES, 134 CA, 134 CF, 147, 128 R; 46/32, 155; 29/482, 483; 156/69, 258, 303.1, 293, 295; 272/57 A, 33 A, 57 D; 40/324, 327

[56] References Cited

UNITED STATES PATENTS

| | | | |
|---|---|---|---|
| 3,156,086 | 11/1964 | Egger | 156/293 X |
| 3,506,520 | 4/1970 | Norcross | 156/293 |
| 3,811,211 | 5/1974 | Morgan | 40/327 X |

FOREIGN PATENTS OR APPLICATIONS

| | | | |
|---|---|---|---|
| 14,302 | 6/1904 | United Kingdom | 273/137 W |
| 803,600 | 10/1958 | United Kingdom | 273/147 |
| 139,020 | 10/1950 | Australia | 273/85 R |
| 733,424 | 7/1955 | United Kingdom | 273/85 R |

*Primary Examiner*—Anton O. Oechsle
*Assistant Examiner*—Harry G. Strappello
*Attorney, Agent, or Firm*—Wolf, Greenfield & Sacks

[57] ABSTRACT

A figure support utilizes a disc on which the figure is mounted. The perimeter of the disc is disposed upon and glued to the seat of a dished base portion. Excess glue is retained in a circumferential groove provided in or adjacent to the region of attachment of the disc to the seat.

3 Claims, 5 Drawing Figures

MOUNTING FOR FIGURES

The present invention relates to figures for use in games, such as simulated cricket, football, hockey or the like, and in particular concerns an improved mounting for such figures.

The invention concerns an improved construction of a known form of figure mounting which comprises a dished base portion and a disc which is adhered to an annular seating ring at the top of the base portion by means of adhesive. The actual figure is usually carried by the disc portion and may be integral therewith, may be adhered thereto by means of adhesive or welding, or may be press fitted thereto. Furthermore, it is known to provide in the interior of the base portion a weight, the function of which is to keep, or tend to keep, the figure in an upright position when in use. The weight may be glued to the interior of the base, or may be loose in which latter case it may be held captive in a predetermined position by suitable means such as pins, studs, grooves or the like. It is to be pointed out that this invention is concerned with the base and disc portions, either with or without the figure and/or weight.

It has been found that with the known figure mountings, the adhesion of the disc to the base has not always been satisfactory. In particular, often too much glue is used, the glueing being done by hand, and when the disc and base are pressed together, excess glue is squeezed usually into the interior of the base, but it can also squeeze onto the exterior of the base portion. Furthermore, with the known arrangement, despite the use of excess glue, sometimes the adhesion between the disc and base portions is insufficient for the purpose to which the mounting is to be put, and complaints arise.

The present invention aims to reduce or overcome these disadvantages and in accordance therewith, the invention provides a mounting for a figure, or carrying a figure, of a game, said mounting comprising a dished base portion and a disc portion adapted to be glued or glued to a seat of the base portion, at least a part of the glue region between the disc portion and said seat having at least one recess, well, groove, pocket or chamber for receiving excess glue as the disc and base are glued together by applying glue between said seat and disc portion and pressing the disc and base portions together.

The disc portion may carry, integrally, a figure, or it may be adapted to carry such a figure.

Furthermore, the interior of the mounting when assembled may house a weight, which may be held in position by adhesive or by means of suitable formations on the base portion and/or disc portion.

It is preferred that the base and disc be annular mouldings of plastics material and in the arrangement that there be two arcuate grooves, slightly less than semi-circles, and diametrically opposite in the region of the disc portion applied to or to be applied to the base portion, such grooves being for, or receiving the excess glue.

In another arrangement, there is a groove in the seat of the base which lies externally of the portion of the seat on which the disc rests.

By providing that excess glue is received in pockets, wells, recesses or in the preferred cases, a groove or grooves, there are provided the two advantages that:

i. the amount of excess glue which can spill into the interior or to the exterior of the mounting is reduced or such spillage is eliminated, and ii. the excess glue in such pockets, grooves or the like will exercise an increased adhesion effect as between the disc and base making separation in use less likely.

Embodiments of the present invention will now be described, by way of example, with reference to the accompanying drawings, wherein.

Figure 1:
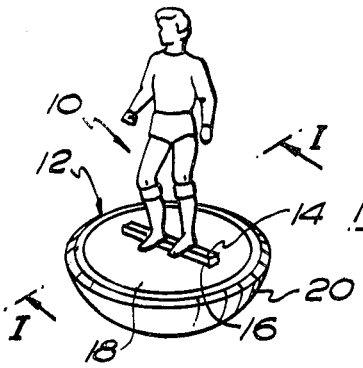
FIG. 1 shows a perspective view of a figure for a game such as football, the figure being mounted upon a mounting according to the invention

Referring to the drawings, in FIG. 1 there is shown a figure playing piece for playing a table game such as table football. Basically, the piece comprises a figure 10, and a mounting 12 which is weighted internally and, as can be seen, is dished to the underside so that it will or will tend to be, self-righting if knocked over. The player 10 in this case is integral with an attachment strip 14 which locates in a slot 16 in a disc portion 18 of the mounting 12 glued to a base portion 20 of the mounting 12. This is only one method of fixing the player 10. There are other methods, and indeed the player can be made integral with disc portion 18. In order securely to anchor the figure 10 to disc portion 18, it is usual to apply glue to slot 16 and/or strip 14 before inserting the strip 14 in the slot 16.

In FIGS. 2, 3, 4 and 5, the figure 10 and strip 14 have been omitted in the interests of simplicity.

Figure 2:
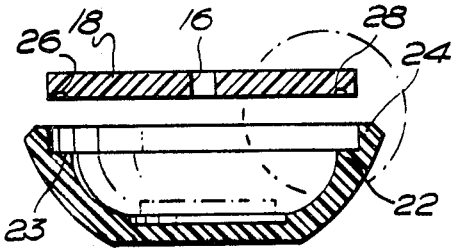
FIG. 2 is an exploded and enlarged sectional elevation of the mounting shown in FIG. 1, the section being on line I—I of FIG. 1

Each of base portion 20 and disc portion 18 is moulded in plastics material, and it will be seen from FIG. 2 that at the top of base portion 20 an internal shoulder 22 presents an upwardly directed, annular seat 23 for a peripheral region of the underside of disc portion 18. A ring 24 of base 20 is located above shoulder 22, and disc portion 18 is of a size to fit within the ring 24 and lie flush with the top surface of the ring 24 as shown in FIG. 4.

On the underside of disc portion 18 at the region which sits on seat 23, the disc portion 18 is provided with two arcuate grooves 26 and 28. In this example, these grooves are of equal length, are symmetrically disposed about the slot 14 which is positioned centrally of the disc portion 18, and are slightly shorter than a full semi-circle.

Figure 4:
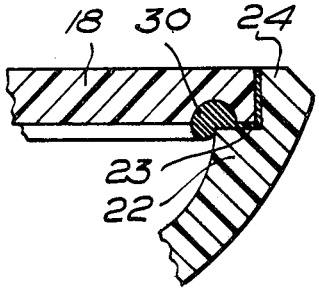
FIG. 4 is a sectional elevation, to a still further enlarged scale, of the detail ringed in FIG. 2, the base portion and disc portion being shown glued together.

These grooves 26 and 28 have the purpose, as shown in FIG. 4, of receiving excess glue 30 when the disc and base portions are pressed together, after application of glue 30 to the base seat 23 and/or the region of the disc portion to sit on said seat, or both. The retention of glue in such grooves 26 and 28 also ensures greater adhesion between the disc and base portions 18 and 20.

Figure 3:
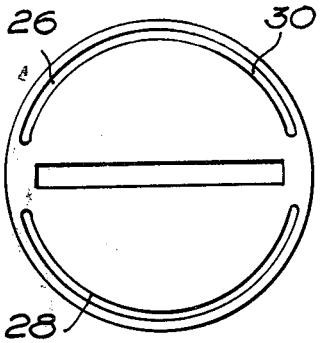
FIG. 3 is an underneath plan of the disc portion of the mounting shown in FIGS. 1 and 2

The disc 18 may be provided with a hole, or notch such as notch 30 shown in FIG. 3 to allow air to escape from inside the base portion 20 as the disc portion 18 is being applied thereto.

Figure 5:
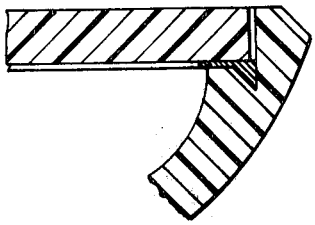
FIG. 5 is a view similar to FIG. 4, showing another embodiment of the invention.

In the embodiment of the invention shown in FIG. 5, the grooves 26 and 28 in disc portion 18 have been omitted and an undercut continuous groove 23A is provided in seat 23 for the reception of the excess glue 30 as shown in FIG. 5. The width of groove 23A is approximately two thirds of the overall width of the seat 23, leaving a supporting hand 23B for support of the disc 18 and the groove goes from minimum depth to maximum depth in a radially outwards direction. Apart from these differences, the embodiment of FIG. 5 is identical to the embodiment of FIGS. 1 to 4 and can have the same modifications. The groove 23A in a modified form of the invention may be interrupted so as to be defined by discreet chambers. In another arrangement the disc portion may have grooves 26 and 28 and the base portion may have groove 23A.

It is to be appreciated that it is not necessary that grooves, or the grooves or groove as described, be used for receiving the excess glue. Many possibilities exist for this excess glue reception. For example, the edge of the disc portion could be chamfered from the periphery to the underside, in order to define, with the seat 23 and ring 24, a pocket for excess glue reception.

What I claim is:

1. In a game piece of the type having

1. a figure;

2. a disc having the figure affixed thereto; and

3. a dished base having an interior seat extending around the rim of the base, the disc fitting within the rim of the base with the perimeter of the disc overlying and being attached by glue to the seat of the base;

the improvement wherein at least a part of the region in which the disc is attached to the seat has a circumferential recess in which excess glue is retained.

2. The improvement according to claim 1 wherein the circumferential recess is a groove in the interior seat of the dished based.

3. The improvement according to claim 1 wherein the circumferential recess is provided by two arcuate grooves in the disc, the arcuate grooves being diametrically opposed and each arcuate groove being slightly less than a semi-circle.

* * * * *